US007626602B2

(12) United States Patent
McShane

(10) Patent No.: US 7,626,602 B2
(45) Date of Patent: Dec. 1, 2009

(54) APPARATUS FOR ELECTROSTATIC COATING

(76) Inventor: Robert J. McShane, 9922 S. Fairland Ave., Chicago, IL (US) 60655-1639

( * ) Notice: Subject to any disclaimer, the term of this patent is extended or adjusted under 35 U.S.C. 154(b) by 420 days.

(21) Appl. No.: 11/532,363

(22) Filed: Sep. 15, 2006

(65) Prior Publication Data

US 2008/0068436 A1 Mar. 20, 2008

(51) Int. Cl.
*B41J 2/41* (2006.01)
*B05C 5/02* (2006.01)

(52) U.S. Cl. ..... 347/112; 118/621

(58) Field of Classification Search ..... 347/112; 239/752, 704, 3, 102.1; 427/469; 118/623, 118/626, 621
See application file for complete search history.

(56) References Cited

U.S. PATENT DOCUMENTS 2,684,656 A * 7/1954 Ransburg ..... 118/626
3,301,488 A * 1/1967 Norris ..... 239/752
3,873,024 A * 3/1975 Probst et al. ..... 239/704
4,508,265 A * 4/1985 Jido ..... 239/3
4,526,804 A 7/1985 Escallon
4,568,569 A 2/1986 Wang
4,582,718 A 4/1986 Escallon
4,749,125 A 6/1988 Escallon et al.
4,795,339 A 1/1989 Escallon
5,035,364 A 7/1991 Escallon
5,179,755 A 1/1993 Winkle, Sr. et al.
5,279,863 A 1/1994 Escallon
5,317,090 A 5/1994 Alexander
5,618,589 A 4/1997 McFarland
5,695,826 A 12/1997 Escallon
5,741,558 A * 4/1998 Otani et al. ..... 427/469
5,749,529 A 5/1998 Kazama et al.
5,800,615 A 9/1998 Lambert et al.
5,996,855 A 12/1999 Alexander et al.

(Continued)

FOREIGN PATENT DOCUMENTS

CA 559449 6/1958

(Continued)

OTHER PUBLICATIONS

Ramseier Technologies (7 pages) cited in U.S. Appl. No. 10/384,381.*

(Continued)

*Primary Examiner*—Stephen D Meier
*Assistant Examiner*—Carlos A Martinez, Jr.
(74) *Attorney, Agent, or Firm*—Vedder Price P.C.

(57) ABSTRACT

The present invention generally relates to an electrostatic coating apparatus for spraying a stream of particles onto a medium, and in particular to an apparatus equipped with a powder coating suspension device such as a multivolume chamber, or a air stream creation device. What is also contemplated is the use of a plurality of variable openings in the enclosure, used in conjunction with a plurality of conductors, to dispose a stream of particles onto a moving medium in successive layers. In yet another embodiment, the stream of particles is directed in a directional electrical field created by electrodes placed adjacent to directional shields. The present disclosure relates to an in-line industrial device able to coat paint, starch, thermoplastic materials, or any other powder material onto a medium by successively controlling a plurality of parameters.

24 Claims, 5 Drawing Sheets

U.S. PATENT DOCUMENTS

| | | | | |
|---|---|---|---|---|
| 6,042,892 | A | 3/2000 | Kim et al. | |
| 6,068,702 | A * | 5/2000 | Bertellotti et al. | 118/621 |
| 6,109,481 | A | 8/2000 | Alexander et al. | |
| 6,197,114 | B1 * | 3/2001 | Rodenberger | 118/623 |
| 6,458,427 | B2 | 10/2002 | Bertellotti et al. | |
| 6,589,607 | B1 | 7/2003 | Edwards et al. | |
| 6,746,535 | B2 | 6/2004 | Hasenour et al. | |
| 6,759,095 | B2 | 7/2004 | Bertellotti et al. | |
| 7,150,412 | B2 * | 12/2006 | Wang et al. | 239/102.1 |
| 2001/0018893 | A1 | 9/2001 | Arverus et al. | |
| 2002/0114884 | A1 | 8/2002 | Friedersdorf et al. | |
| 2003/0203131 | A1 | 10/2003 | Bertellotti et al. | |
| 2005/0160978 | A1 | 7/2005 | Kerbel et al. | |

FOREIGN PATENT DOCUMENTS

| | | | |
|---|---|---|---|
| WO | WO 01/85353 | | 11/2001 |
| WO | WO02/078854 | * | 10/2002 |
| WO | WO 03/055609 | | 7/2003 |

OTHER PUBLICATIONS

TurboTech, "Air Knife Design", http://web.archive.org/web/20050405010238/www.air-knives.com/design.htm (Apr. 2005 archive of www.air-knives.com/design.htm).*

* cited by examiner

APPARATUS FOR ELECTROSTATIC COATING

FIELD OF THE INVENTION

The present invention generally relates to an electrostatic coating apparatus for spraying a stream of particles onto a medium, and in particular, to an apparatus equipped with a dual-chamber enclosure or with a plurality of variable openings for successive layer coating onto a medium.

BACKGROUND OF THE INVENTION

During the industrial coating process, a wide variety of media are covered with different surface materials. For example, paper may be covered with starch solutions for improved heat resistance characteristics, and metal sheeting may be coated with paint or latex for aesthetic value or corrosion protection of oxidizing surfaces. The coating of materials on media is widely used in the industry, and improved, cost-effective apparatus, methods, and devices are continuously sought. The coating of liquids may utilize volatile solvents and require drying processes that create gas wastes requiring treatment. Apparatuses and methods for applying coating material in powder form to a medium do not suffer from the above shortcomings. Powders must adhere temporarily to the medium and be uniformly spread to prevent bumps or cause problems during post-treatment operations. Once applied to a medium, powders may require post-treatment operations such as baking to fix the powder permanently on the surface.

One of the known ways to adhere a powder to a surface without adding unnecessary agents or adhesives is by using the electrostatic adhering capacity of a charged stream of particles made from a powder suspended in a gas and placed in contact with a medium that has a different electrical energy or is grounded. The Law of Coulomb provides that electrostatic force felt by two bodies charged with the same polarity charge is a repulsive force, and the force felt by two bodies charged with opposite polarity is an attractive force. Once the powder particles in a stream are charged, either by removing or adding surface electrons, the particles are then drawn by the electromagnetic force to a grounded medium in proportion to Coulomb's Law. Another advantage of electrostatic charging of a stream of particles is the creation of repulsion forces between neighboring particles in the stream placed at equivalent energy to aid in the spatial distribution of the particles within the stream of particles. Additionally, charged particles are drawn by a stronger electrostatic force on a surface where other particles have not yet attached.

Electrostatic charges can be placed on a medium by contact electrification, triboelectric electrification, or physical rubbing of surfaces such as the friction of a balloon on a piece of clothing or the displacement of shoes over a carpet. Another way to create an electrical charge on an item is to circulate the item in a strong electrical field in excess of the breakdown strength of air, a field of such intensity that ionized particles are formed. These ions are collected on the surface of the item in the corona discharge zone around a conductor by moving the powder through the corona region. These particles exit the corona superficially charged with an ionic charge and are then vulnerable, due to their low mass, to electrostatic forces created by their charge. Particles of both conductive material and insulating material are vulnerable to corona charging. Nonconductive particles, since they are less likely to redirect the position of superficial ionic charges, are more likely to maintain their newly gained electrostatic charge.

What is known is the use of a high-level energy conductor located at the source of a stream of particles to ionize the powder or the use of a highly charged and dangerous conductive net structure placed in proximity to a medium. What is also known is the use of a chamber wherein the medium and the conductor are placed in contact with particles in the closed environment, or the use of an enclosure where ionized particles are collected after being placed in proximity to a conductor in a small enclosure before the ionized particle flow is directed onto a medium outside the enclosure. Drawbacks of these known technologies include the creation of corona discharges between the conductor surrounding low-level charge elements located in close proximity to the source of powder particles, the need to place the conductor in the path of the stream of particles, the creation of enclosed devices where high-level voltage must be managed, and distribution systems where the particles are not suspended in the air sufficiently enough to offer an optimal collection of the ions in the air. Although many of these devices are able to perform their intended functions in a workmanlike manner, none of them adequately addresses the combination of these drawbacks. What is needed is an apparatus able to adequately fluidize the particles from a powder source and place them in a particle stream, an apparatus where conductors are protected and offset from the particle stream, and an apparatus able to uniformly deposit the particles onto a medium. The present invention solves these and many other problems associated with currently available apparatuses for electrostatic coating.

SUMMARY

The present invention generally relates to an electrostatic coating apparatus for spraying a stream of particles onto a medium, and in particular, to an apparatus equipped with a powder coating suspension device, such as a multivolume chamber or an air stream creation device. What is also contemplated is the use of a plurality of variable openings in the enclosure, used in conjunction with a plurality of conductors, to dispose a stream of particles onto a moving medium in successive layers. In yet another embodiment, the stream of particles is directed in a directional electrical field created by electrodes placed adjacent to directional shields. The present disclosure relates to an in-line industrial device able to apply paint, starch, or any other powder material onto a medium by successively controlling a plurality of parameters, including the above-mentioned novel features, including but not limited to the size of an inside aperture within the enclosure, the size of the opening of variable openings on the enclosure, the use of air knives to improve particle suspension distribution, the use of successive variable openings on the enclosure, the change in the flow of input gas, and the change in the voltage or the location of the conductor.

BRIEF DESCRIPTION OF THE DRAWINGS

The features of the present disclosure are believed to be novel and are set forth with particularity in the appended claims. The disclosure may be best understood by reference to the following description taken in conjunction with the accompanying drawings. The figures that employ like reference numerals identify like elements.

DETAILED DESCRIPTION

In the following detailed description, reference is made to the accompanying drawings that show, by way of illustration, a possible industrial embodiment of the disclosure centered around an improved electrostatic coating apparatus. This embodiment is described with detail sufficient to enable one skilled in the art to practice the disclosure. It is understood that each subfeature or element described in this embodiment of the disclosure, although unique, is not necessarily exclusive and can be combined differently and in a plurality of other possible embodiments because they show novel features. It is understood that the location and arrangement of individual elements, such as geometrical parameters within each disclosed embodiment, may be modified without departing from the spirit and scope of the disclosure. In addition, this disclosed embodiment can be modified based on a plurality of industrial and commercial necessities, such as, in a nonlimiting example, a large-scale coating process where several units are required at different locations along a production line or in a confined area when the atmospheric control of the stream of particles is to be recycled. The disclosed apparatus can be modified according to known design parameters to implement this disclosure within these specific types of operation. Other variations will also be recognized by one of ordinary skill in the art. The following detailed description is, therefore, not to be taken in a limiting sense.

Figure 1:
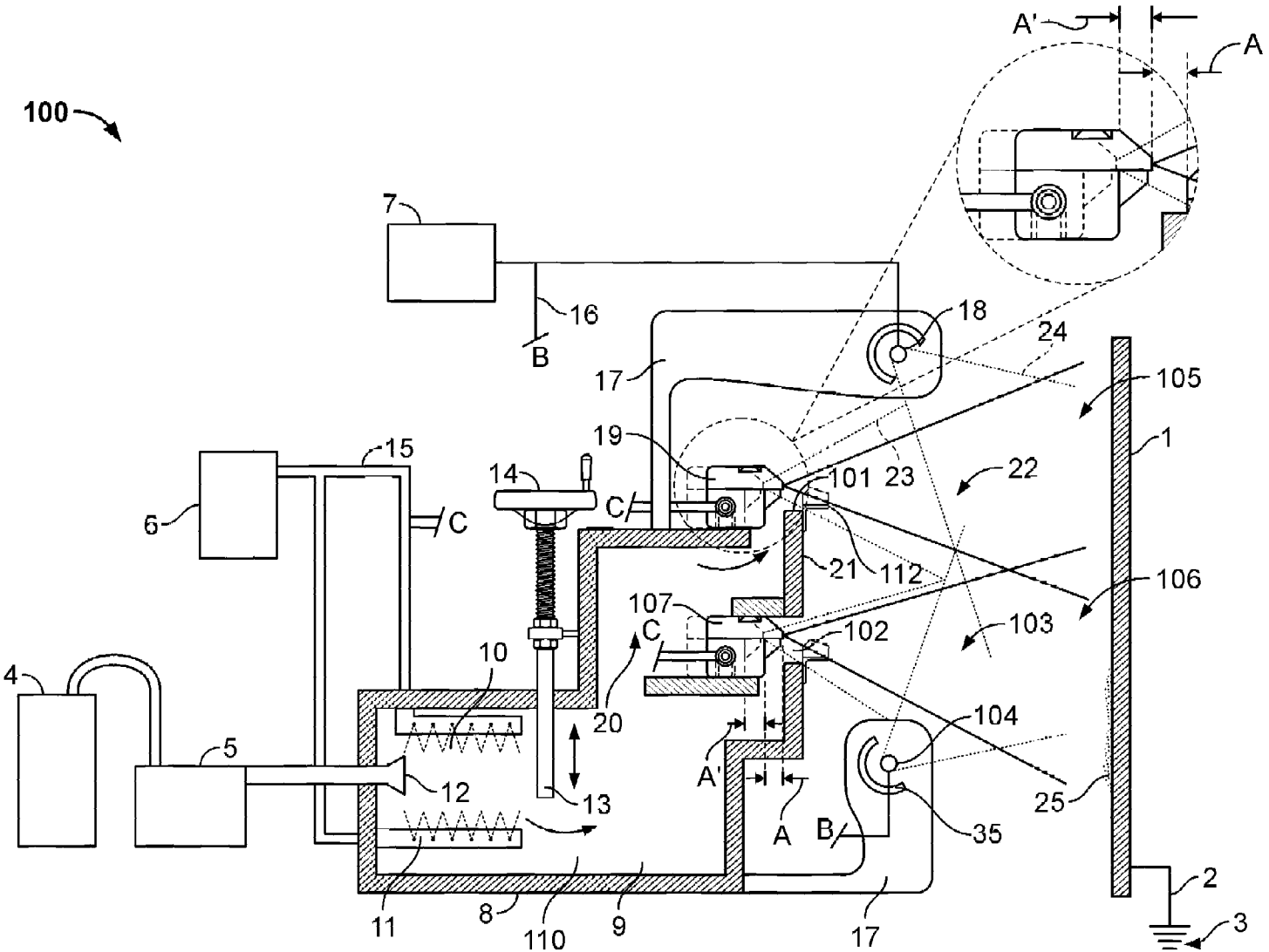
FIG. 1 is a diagrammatical representation of the apparatus for electrostatic coating according to a first embodiment of the present disclosure.

The present disclosure relates to an electrostatic coating apparatus 100 as shown in FIG. 1 according to a first embodiment of the present disclosure. The electrostatic coating apparatus 100 includes an enclosure 8 with a first opening 101 for discharging a first stream of suspended particles 22 onto a medium 1 and a second opening 102 disposed adjacent to the first opening for discharging a second stream 103 of suspended particles onto the medium 1. FIG. 1 shows particles 25 fixed upon the surface of the medium 1 and held in place by electrostatic attraction forces between the particles 25 and the medium 1. While FIG. 1 shows a vertically oriented medium 1 grounded 2 to earth 3, it is understood that the electrostatic coating apparatus 100 may be placed in any orientation resulting in a medium 1 also oriented in any orientation. One of ordinary skill in the art understands that while the medium 1 is shown in a static configuration, commercial and industrial coating techniques may require the use of rolled medium 1 unfolding before the electrostatic coating apparatus 100 before it is rolled, folded, or stored, or a long, rigid item moved before the electrostatic coating apparatus 100. It is also understood that any type of medium, made of any type of conductive or nonconductive material and presenting a variety of surface geometry and topology, can be coated. While in a preferred embodiment (shown) the medium is grounded using conventional grounding techniques, the electrostatic coating apparatus functions on attractive forces created between the particles and the medium by creating a difference in ionic potential, so what is contemplated is the use of a medium 1 at any ionic potential sufficiently different from the average ionic potential of the particles to induce electrostatic attraction forces.

The enclosure 8 as shown in FIG. 1 is made of a thick wall of strength sufficient to contain internal pressures created during the process of suspending the particles within a gas, also known as fluidization of the particles. FIGS. 2-6 show one possible industrial and commercial embodiment of the invention shown in FIG. 1. These figures show a stainless steel casing with surface strengtheners described in detail hereinafter. The fluidization process includes the use of a pump 5 designed to measure and supply the enclosure 8 with a controlled volume of particles in a powder form to be coated on the medium. FIG. 1 shows a container 4 containing a powder supply for the pump 5. In a preferred embodiment, the pump 5 is a digital density feeder pump. In yet another preferred embodiment, the pump 5 is digital density feeder pump from Ramseier Technologies AG. While one type of pumping technology is described, it is understood that any means designed to transfer powder from a first location to a second location is contemplated, including but not limited to gravitational supply of powder located above the enclosure.

Figure 2:
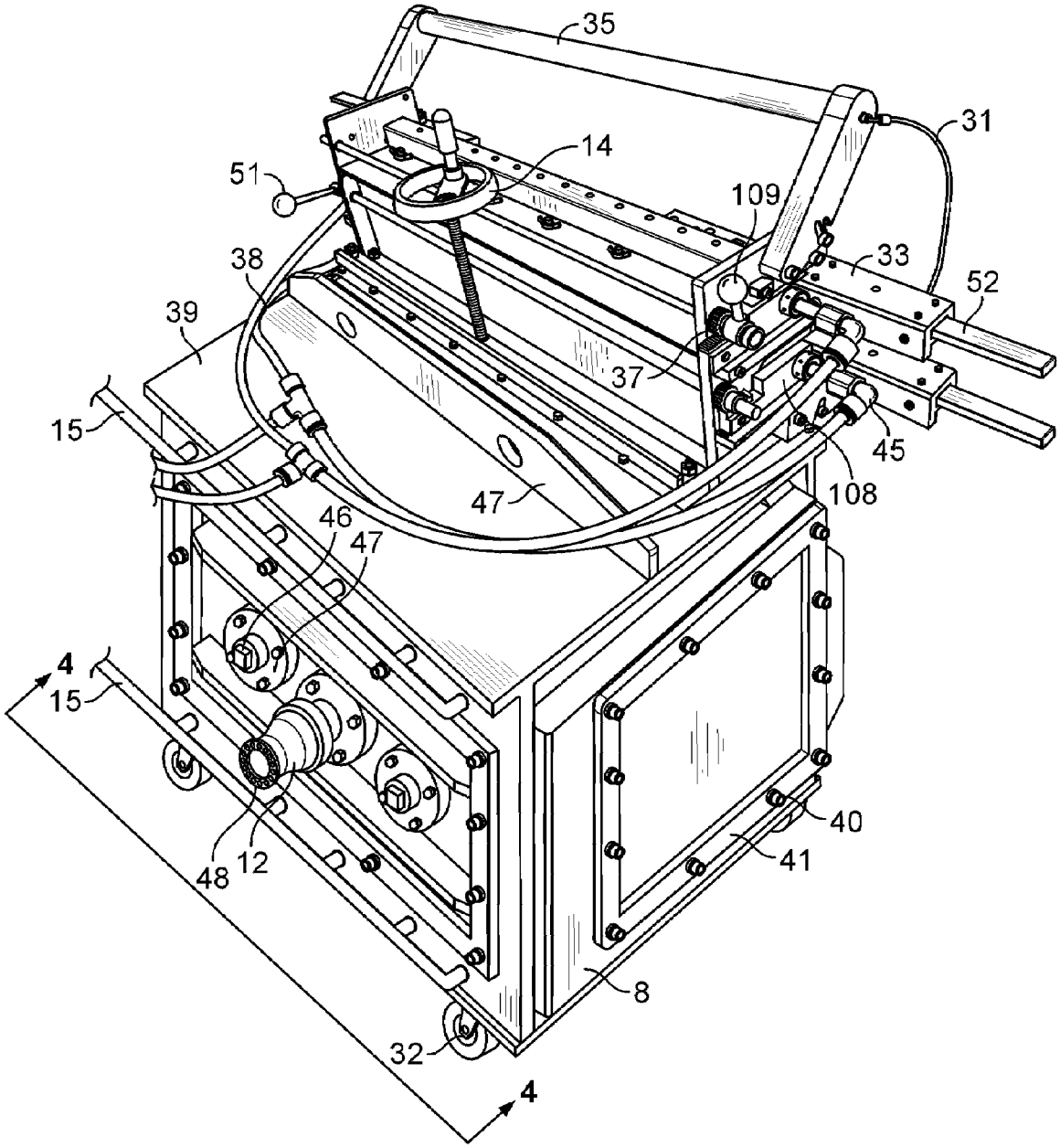
FIG. 2 is a front perspective view of the apparatus described in FIG. 1.
Figure 4:
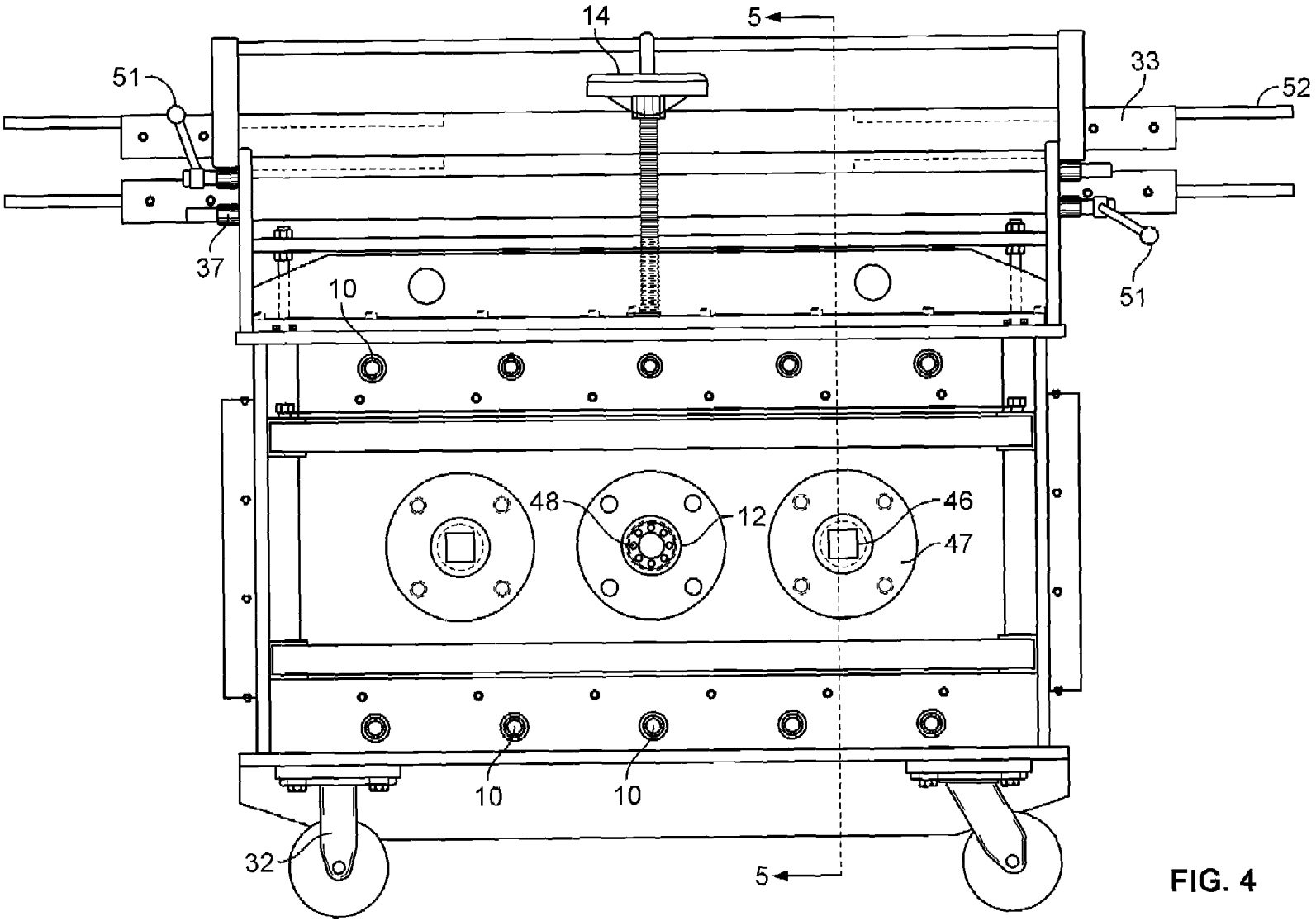
FIG. 4 is front view of the apparatus described in FIG. 1.
Figures 5, 6:
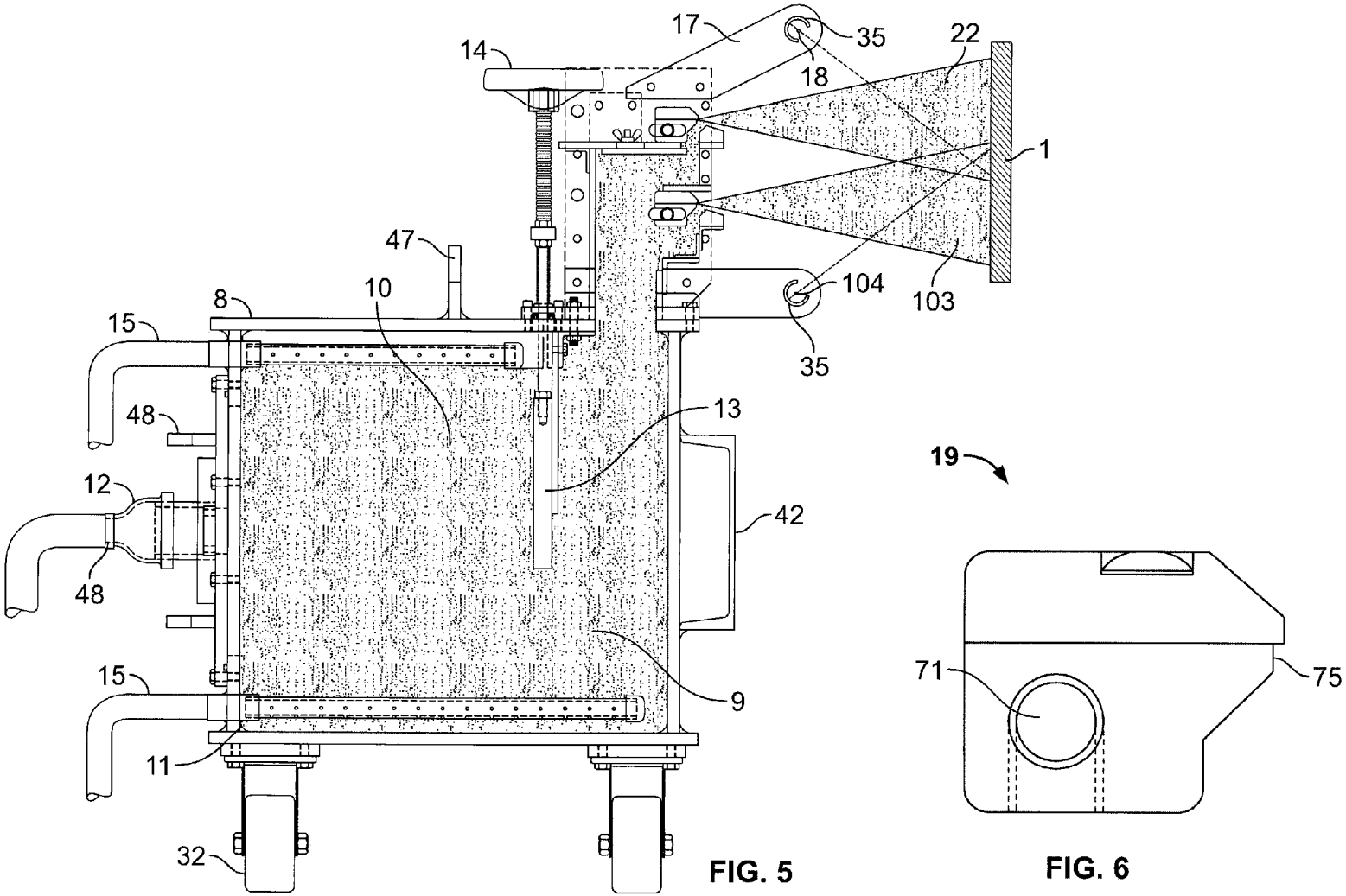
FIG. 5 is a sectional side view along 5-5 as shown on FIG. 4 schematically representing the apparatus shown in FIG. 1 along with suspended particle distribution during a possible mode of operation of the coating apparatus.
FIG. 6 is a side detail view of the air knife.

Openings 101, 102 in the enclosure 8 create streams of particles 22, 103 by releasing the pressurized contents of the enclosure 8 where particles have been suspended in a gas with lower pressure than atmospheric air. FIG. 1 shows a source of compressed air 6 such as a condenser or a pressurized source of gas or any equivalent connected by a series of pipes 15 to the inside of the enclosure 8. In a preferred embodiment as shown in FIG. 2, the gas is compressed air and is brought to the inside of the enclosure 8 by a series of five top pipes and five bottom pipes 11 connected to a main container. A side view of gas release pipes 11 is shown in FIG. 5. In one preferred embodiment, the release pipes 11 are capped and a series of holes are made along the length of these pipes. In another preferred embodiment, the length of the pipes may vary according to the inside geometry of the enclosure 8. FIG. 5 shows a contemplated configuration where the top pipes are shorter than the bottom pipes. The release pipes 11 are covered with small openings to allow the pressurized gas to be released (shown by dashed lines) and blown into the enclosure 8 in order to fluidize the powder brought within the enclosure by the powder release 12. It is understood that while one possible air mixing configuration is shown, where the release pipes are located above and under the powder release 12, any configuration where gas can be used, funneled, and directed to fluidize the powder into suspended particles is contemplated. In one preferred embodiment, the powder release 12 allows for a full circumferential release of 360 degrees. FIGS. 2 and 4 show a possible embodiment where three openings are made in the front of the enclosure to place the powder release 12 and where two of the openings are capped 46. It is understood by one of ordinary skill in the art that the input of powder into the enclosure 8 can be made using several inlets based on the amount of coating to be done.

The first stream of particles 22 and the second stream of particles 103 are shown to originate from the gas releasing devices 19, but what is contemplated is the release of streams of particles from the first and second openings 101, 102 even if the gas releasing devices 19 are not present and where the first and second stream of particles 22, 103 originate from the first and second openings 101, 102. In one preferred embodiment, the medium may be coated when moving vertically at speeds of up to 300 feet per minute. The medium in a preferred embodiment is made of a web and is moved vertically relative to the electrostatic coating apparatus 100. In another embodiment, the medium is a metal sheet. Experimentation has shown that a medium moving vertically in front of the electrostatic coating apparatus 100 can be coated at horizontal distances of one to five feet away from the first and second openings 101, 102. While a preferred range of operational parameters is given, what is contemplated is modification of the geometrical parameters of the electrostatic coating apparatus 100 to allow coating of a medium at closer and farther distances than those given above.

Figure 3:
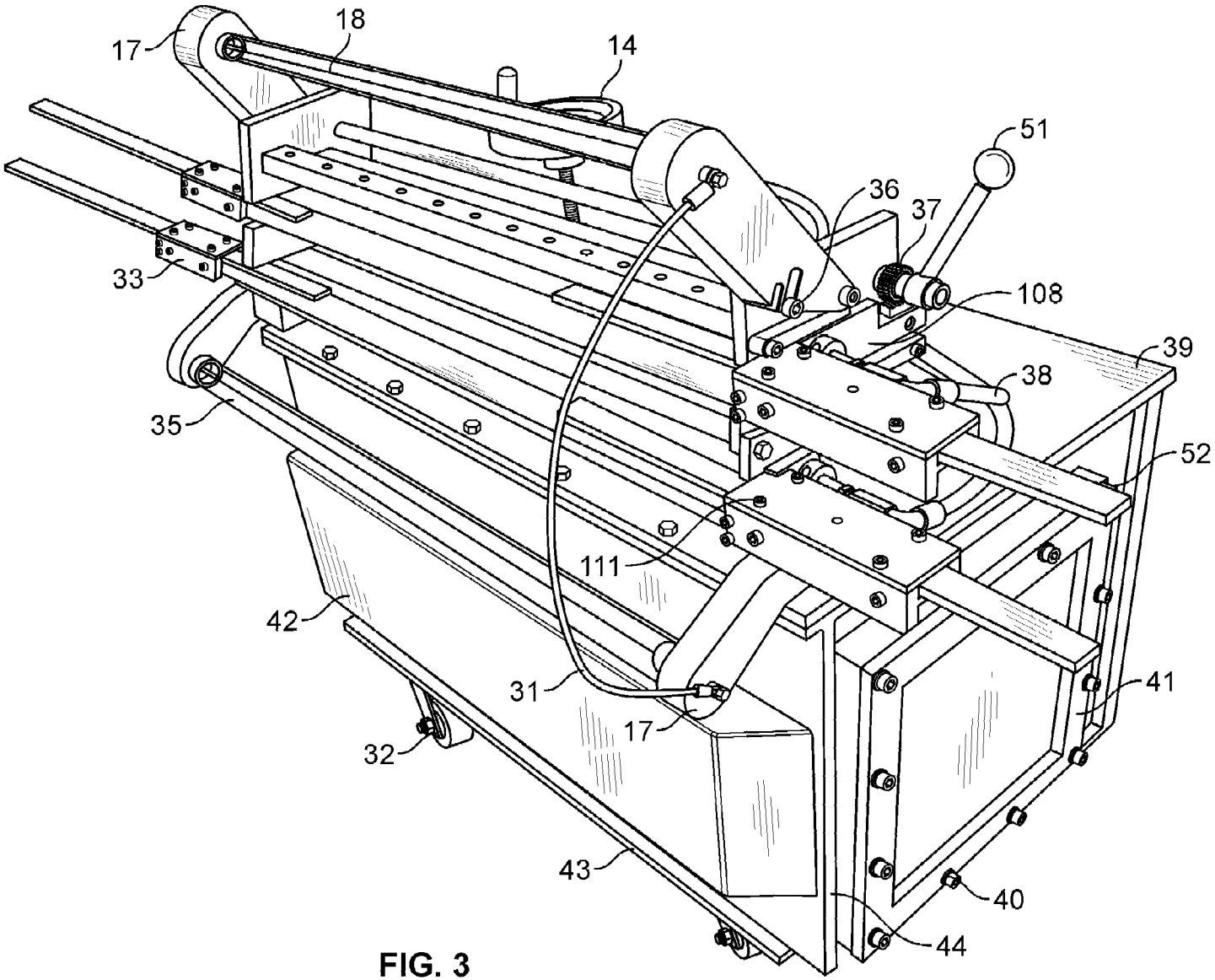
FIG. 3 is a back perspective view of the apparatus described as FIG. 1.

The enclosure 8 also includes a first electrode 18 forming a first electrostatic field 105 thereabout. The first electrode 18 is disposed adjacent to the first stream 22 such that the first electrostatic field 105 imparts a charge to the first stream 22 and the second stream 103. A second electrode 104 forming a second electrostatic field 106 thereabout is disposed adjacent to the second stream 103 such that the second electrostatic field 106 imparts a charge to the second stream 103 and the first stream 22. In one preferred embodiment, the electrodes 18, 104 are made of electrified wires located horizontally along the first and second openings 101, 102. In another preferred embodiment, the electrodes 18, 104 are partly covered with a directional shield 35 adjacent to the charged electrical wire for directing the first and second electrostatic fields 15, 106 to a selected portion of the first and second streams 22, 103. In yet another preferred embodiment, the directional shield 35 is a tube comprising an opening along the orientation of the charged electrical wires. FIGS. 2-5 show an embodiment where two long arms 17 located on each side of the area where the first and second streams 22, 103 are placed at both extremities of the coating area and are encased in protective and insulated material. The arms 17 at attached in a preferred embodiment to the enclosure 8, but it is understood that the electrodes 18, 104 along with the associated arms 17 may not be located on the enclosure 8. A power cable 31 as shown in FIGS. 2-3 provides power and voltage to the electrodes 18, 104. FIG. 3 shows one possible configuration of the wire electrodes 18, 104 attached to the lateral long arms 17 and the directional shields 35. It is understood by one of ordinary skill in the art that electrodes must be placed in a position able to maintain the electrical charge in the electrode, insulate the electrodes from surrounding elements, protect the electrodes from accidental corona discharges created by a high voltage placed on the electrodes 18, 104, and protect operators of the apparatus 100 from shocks. What is also contemplated is the use of a directional shield 35 oriented in such a direction to limit the accumulation of particles from within the directional shield 35. The directional shields 35 also protects the electrodes 18, 104 from power build-ups. A power generator 7 as shown in FIG. 1 is electrically coupled to both electrodes 18, 104 by electrical connectors 16. FIG. 1 also shows a jump section B-B for the convenience of the diagram where the electrical connectors 16 are connected to both electrodes.

What is contemplated is the use of any coating originally supplied in powder form and particles that may be suspended in a gas within the enclosure 8. The powder may be selected from a group consisting of paint, starch, and thermoplastic materials such as nylon. FIG. 1 also discloses an enclosure 8 with a first gas-releasing device 19 to release the first stream of suspended particles 105 onto the medium 1. A second gas-releasing device 107 may also be used to release the second stream 106 of suspended particles onto the medium 1. In one preferred embodiment, the first and second gas-releasing devices are air knives. FIG. 6 is a side detail view of the air knife. Compressed gas or air flows through an inlet 71 into a plenum chamber of the air knife. The flow is directed to a precise, slotted orifice. As the primary airflow exits the slitted nozzle 75, it creates a uniform sheet of air across the length of the slitted nozzle 75 that immediately pulls in surrounding air. Returning to FIG. 1, the gas-releasing devices 19, 107 are placed next to the first and second openings 101, 102 in order to guide the suspended particles located within the enclosure 8. What is also contemplated is the attachment of the gas-releasing devices 19, 107 on a movable rack 108 as shown in FIGS. 2-3. A detailed view of the change in position of the gas-releasing devices 19, 107 is shown on FIG. 1. The alternate position of the gas-releasing devices 19, 107 is shown in the open (dashed lines) and the closed configurations (solid lines). An opening variation of A is shown while the gas-releasing devices 19, 107 are moved by a distance A'. What is contemplated is the use of a plurality of technology to define variable openings 101, 102 either by the movement of obstructions located over the openings (as shown) or by the use of diaphragms or pressure drop devices. FIGS. 2-5 show a possible embodiment where handles 51, 109 are used to slide blocks 108 using a crenate wheel and section to vary the openings 101, 102. While a hand-operated system is shown, what is contemplated is any system to modify the openings 101, 102, including hydraulic, pneumatic, or electric systems. FIG. 2 illustrates one possible set of tubes and connectors 38, 45 used to supply the gas-releasing devices 19, 107 with compressed gas. FIG. 1 shows as pipe 15 C-C a possible connection of the compressor 6 with the gas-releasing devices 19, 107.

In a possible embodiment, the charge imparted by two electrodes 18, 104 onto the first and second stream of particles 22, 103 varies as the distance between the conductor and the stream varies. In the embodiment shown in FIG. 5, the charge imparted by the second electrode 104 upon the second stream of particles 103 is greater than the charge imparted by the second electrode 104 upon the first stream of particles 103. FIG. 1 shows a configuration where the first electrode 18 creates a directional electrostatic field 24 based on the opening created in the shield 35. FIG. 5 shows a configuration where the median direction of the electrostatic field 24 is created by each electrode 18, 104. The directional shield 35 serves to direct the field 24 to a certain area.

FIG. 1 also shows the electrostatic coating apparatus with an enclosure 8 with a wall defining a volume 110 and a baffle 13 movably connected to the enclosure (shown by an arrow) defining within the volume 110 a storage area 10 and a discharge area 9 separated by the baffle 13 and wherein the baffle 13 defines a passageway (shown by a sliding arrow) between the storage area 10 and the discharge area 9. What is contemplated is the use of a baffle 13 to create a dynamic pressure drop zone within the enclosure 8 and the associated volume 110 to offer a first level of flow control and flow regulation of the electrostatic coating apparatus 100. The powder placed in suspension by the compressed gas within the enclosure is then slowly released in a discharge area. In a preferred embodiment as shown in FIG. 5, the baffle 13 is controlled by a rotating hand lever 14. A head portion 20 containing the variable openings 101, 102 and the gas-releasing devices 19, 107 and holding the electrodes 18, 104 is located above the discharge area 9. While the design and construction of a cabinet-sized enclosure 8 is shown, what is contemplated is the use of any enclosure 8 where the described features are found. By way of nonlimiting example, the device shown in FIGS. 2-5 allows for the coating of a medium 1 at a certain height from the floor where the electrostatic coating apparatus 100 is positioned using a series of wheels 32. FIGS. 2-5 show mechanical reinforcement structures, such as doors 41, 42, located on the sides and back of the enclosure and reinforcement ribs 47, 48 designed to prevent any deformation of the enclosure 8 once it is pressurized. FIG. 1 is a side view and does not show the width of the electrostatic coating apparatus 100. FIGS. 2-5 show the apparatus where the variable openings 101, 102 are located along the entire length of the electrostatic coating apparatus 100. A series of closure bars 52 are placed on each side of the electrostatic coating apparatus 100 using a rail 33 device equipped with guiding bolts 111 that allows for the lateral regulation of the variable openings 101, 102. In a preferred embodiment, a long strip of material measuring a fraction of the width of the electrostatic coating apparatus 100 is coated (not shown). The closure bars 52 on each side of the electrostatic coating apparatus 100 are then slid into the rails 33 and locked into position, which defines variable-width apertures 101, 102 that coincide with the width of the medium 1. FIG. 3 shows one possible configuration where the width of the medium is almost half of the width of the enclosure 8 and where the closure bars 52 are accordingly closed. In another embodiment, angled blocks 112 are placed along the variable openings 101, 102 to control the flow of the stream of particles 22, 103. The angled blocks 112 allow for the control of air and a controlled expansion of the stream of particles 22, 103 over the surface.

The invention as disclosed herein is not limited to the particular details of the described electrostatic coating apparatus, and other modifications and applications may be contemplated. Further changes may be made in the above-described method and device without departing from the true spirit and scope of the invention herein involved. It is intended, therefore, that the subject matter in the above disclosure should be interpreted as illustrative, not in a limiting sense.

What is claimed is:

1. An electrostatic coating apparatus comprising:

an enclosure for holding a mixture of gas and suspended particles comprising a first opening for discharging a first stream of the mixture of gas and suspended particles onto a medium and a second opening disposed adjacent to the first opening for discharging a second stream of the mixture of gas and suspended particles onto the medium;

a first electrode forming a first electrostatic field thereabout, the first electrode disposed adjacent to the first stream such that the first electrostatic field imparts a charge to the first stream and the second stream; and a second electrode forming a second electrostatic field thereabout, the second electrode disposed adjacent to the second stream such that the second electrostatic field imparts a charge to the second stream and the first stream, wherein the enclosure further comprises a first gas-releasing device to further release the first stream of suspended particles onto the medium, and a second gas-releasing device to further release the second stream of suspended particles onto the medium, and wherein the first and the second gas-releasing devices are air knives with a slitted nozzle for creating a uniform sheet of air across the length of the slitted nozzle; and wherein the first opening and the second opening are of variable size and the gas-released devices are on a movable rack with a handle for the opening variation of the first opening and the second opening.

2. The electrostatic coating apparatus of claim 1, wherein the suspended particles are selected from a group consisting of paint, starch, and thermoplastic materials such as nylon.

3. The electrostatic coating apparatus of claim 1, wherein the first opening and the second opening further include an angled block to control the flow of the first and second stream of particles.

4. The electrostatic coating apparatus of claim 1, wherein the medium is moved vertical at a speed of up to 300 feet per minute.

5. The electrostatic coating apparatus of claim 4, wherein the medium is a metal sheet.

6. The electrostatic coating apparatus of claim 1, wherein the medium is electrically grounded.

7. The electrostatic coating apparatus of claim 1, wherein the charge imparted to the second stream by the second electrode is different but not opposite to the charge imparted to the first stream by the second electrode.

8. The electrostatic coating apparatus of claim 1, wherein the first and second electrodes are charged electrical wires.

9. The electrostatic coating apparatus of claim 8, further comprising a first directional shield adjacent to the first charged electrical wire for directing the first electrostatic field to a selected portion of the first stream, wherein the first directional shield is a tube comprising an opening along the orientation of the first charged electrical wire.

10. The electrostatic coating apparatus of claim 1, further comprising a first directional shield adjacent to the first electrode for directing the first electrostatic field to a selected portion of the first stream.

11. The electrostatic coating apparatus of claim 1, farther comprising a second directional shield adjacent to the second electrode for directing the second electrostatic field to a selected portion of the second stream.

12. The electrostatic coating apparatus of claim 1, wherein the enclosure includes mechanical reinforcements, further comprising a series of closure bars on each side of the coating apparatus for regulation of the variable openings, and wherein the closure bars include a rail for sliding the bars into a locked position over the variable openings.

13. An electrostatic coating apparatus comprising:

an enclosure comprising a wall defining a volume;

a baffle movably connected to the enclosure defining within the volume a storage area and a discharge area and wherein the baffle defines a passageway between the storage area and the discharge area;

a mixture of gas and suspended particles within the volume; and a first electrode for forming an electrostatic field to impart a charge to a first stream of particles, wherein the enclosure further comprises a first variable opening in communication with the discharge area for discharging a first stream of particles, and a second variable opening in communication with the discharge area for discharging a second stream of particles, wherein each of the first and second variable opening comprises a gas-releasing device to further discharge the streams of paint particles, and wherein the gas-releasing device is an air knife with a slitted nozzle for creating a uniform sheet of air across the length of the slitted nozzle; and wherein the first opening and the second opening are of variable size and the gas-released devices are on a movable rack with a handle for the opening variation of the first opening and the second opening.

14. The electrostatic coating apparatus of claim 13, wherein the suspended particles are selected from a group consisting of paint, starch, and thermoplastic materials such as nylon.

15. The electrostatic coating apparatus of claim 13, wherein the paint particles are suspended in the storage area using a pneumatic air-blowing device having pipes with a series of holes.

16. The electrostatic coating apparatus of claim 13 further comprising a second electrode for forming a second electrostatic field to impart a charge to the first stream.

17. The electrostatic coating apparatus of claim 16, wherein the second electrode imparts a charge to the second stream.

18. The electrostatic coating apparatus of claim 13, further comprising a first directional shield adjacent to the electrode for directing the electrostatic field to a selected portion of the first stream.

19. An electrostatic coating apparatus comprising:

an enclosure for holding a mixture of gas and suspended particles;

a pump operatively coupled to the enclosure for pumping a plurality of particles into the enclosure;

a supply of compressed air operatively coupled to the enclosure;

a control device operatively coupled to the enclosure; and a power source electrically coupled to the control device and a first electrode, wherein the enclosure comprises a wall defining a volume, a baffle movably connected to the enclosure defining within the volume a storage area and a discharge area, a first variable opening for discharging a first stream of particles, and a second variable opening for discharging a second stream of particles, and gas release pipes, p1 wherein the control device controls a flow of particles within the enclosure by controlling the baffle, the first variable opening, the second variable opening, the pump, and an intensity of the power of the first electrode; and wherein the first opening and the second opening are of variable size and wherein the supply of compressed air are on a movable rack with a handle for the opening variation of the first opening and the second opening.

20. The electrostatic coating apparatus of claim 19, wherein the suspended particles are selected from a group consisting of paint, starch, and thermoplastic materials such as nylon.

21. The electrostatic coating apparatus of claim 19, wherein the first variable opening and the second variable opening comprises a lateral control bar.

22. An electrostatic coating apparatus comprising:

an enclosure with surface strengtheners for holding a pressurized fluidifled mixture of gas and suspended particles comprising a first variable opening for discharging a first stream of the mixture of gas and suspended particles onto a medium and a second variable opening disposed adjacent to the first opening for discharging a second stream of the mixture of gas and suspended particles onto the medium;

a first electrode forming a first electrostatic field thereabout, the first electrode disposed adjacent to the first stream such that the first electrostatic field imparts a charge to the first stream and the second stream; and a second electrode forming a second electrostatic field thereabout, the second electrode disposed adjacent to the second stream such that the second electrostatic field imparts a charge to the second stream and the first stream, wherein the enclosure further comprises a first gas-releasing device to further release the first stream of suspended particles onto the medium, and a second gas-releasing device to further release the second stream of suspended particles onto the medium, and wherein the first and the second gas-releasing devices are air knives wherein the enclosure includes a series of pipes with small openings connected to a source of compressed air, for the release of the gas from the source into the enclosure; and wherein the first opening and the second opening are of variable size and the gas-releasing devices are on a movable rack with a handle for the opening variation of the first opening and the second opening.

23. The electrostatic coating apparatus of claim 22, wherein the first and second variable openings are regulated with blocks slid over openings using at least a handle.

24. The electrostatic coating apparatus of claim 23, further comprising a series of closure bars on each side of the coating apparatus for further regulation of the variable openings, and wherein the closure bars include a rail for sliding the bars into a locked position over the variable openings.

* * * * *